US012025000B2

(12) United States Patent
Kalb et al.

(10) Patent No.: US 12,025,000 B2
(45) **Date of Patent: *Jul. 2, 2024**

(54) DOWNHOLE FIBER OPTIC TRANSMISSION FOR REAL-TIME WELL MONITORING AND DOWNHOLE EQUIPMENT ACTUATION

(71) Applicant: Dril-Quip, Inc., Houston, TX (US)

(72) Inventors: Frank D. Kalb, Cypress, TX (US); Justin D. Gorhum, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/453,214

(22) Filed: Aug. 21, 2023

(65) Prior Publication Data

US 2023/0407741 A1 Dec. 21, 2023

Related U.S. Application Data

(63) Continuation of application No. 17/088,840, filed on Nov. 4, 2020, now Pat. No. 11,767,754.

(Continued)

(51) Int. Cl.

| | |
|---|---|
| ***E21B 47/135*** | (2012.01) |
| ***E21B 19/02*** | (2006.01) |
| ***E21B 33/043*** | (2006.01) |

(52) U.S. Cl.

CPC ..... *E21B 47/135* (2020.05); *E21B 19/02* (2013.01); *E21B 33/043* (2013.01)

(58) Field of Classification Search

CPC ..... E21B 47/135; E21B 19/02; E21B 33/043

(Continued)

(56) References Cited

U.S. PATENT DOCUMENTS

| | | | |
|---|---|---|---|
| 6,200,152 | B1 | 3/2001 | Hopper |
| 10,900,315 | B2 | 1/2021 | Xiao |

(Continued)

FOREIGN PATENT DOCUMENTS

| | | | |
|---|---|---|---|
| EP | 2877691 | A1 | 1/2014 |
| WO | 2014/018010 | A1 | 1/2014 |

(Continued)

OTHER PUBLICATIONS

Search Report issued in related United Kingdom Patent Application No. 2017219.3 dated May 17, 2021, 2 pages.

(Continued)

*Primary Examiner* — Matthew Troutman
*Assistant Examiner* — Patrick F Lambe
(74) *Attorney, Agent, or Firm* — Baker Botts L.L.P.

(57) ABSTRACT

A subsea wellhead system includes: a hanger including a first fiber optic cable; a tree including a second fiber optic cable; a seal sub configured to be coupled to the tree and engaged with the hanger, the seal sub including a fiber optic communications line configured to be communicatively coupled to the first and second fiber optic cables; a transducer configured to be disposed at a downhole location and configured to be communicatively coupled to the first fiber optic cable; a first photodetector disposed in the hanger and configured to convert a light signal traveling through the first fiber optic cable from downhole to an electrical signal communicated to the electrical connection; and a first optical transmitter disposed in the seal sub and configured to convert the electrical signal traveling through the electrical connection into a light signal communicated to the second fiber optic cable.

18 Claims, 4 Drawing Sheets

Related U.S. Application Data

(60) Provisional application No. 62/934,290, filed on Nov. 12, 2019.

(58) Field of Classification Search
USPC ..... 166/335
See application file for complete search history.

(56) References Cited

U.S. PATENT DOCUMENTS

| | | | | |
|---|---|---|---|---|
| 11,767,754 | B2 * | 9/2023 | Kalb | E21B 33/035 166/335 |
| 2003/0042019 | A1 * | 3/2003 | Harkins | E21B 33/072 166/70 |
| 2004/0262008 | A1 | 12/2004 | Deans et al. | |
| 2009/0066535 | A1 | 3/2009 | Patel et al. | |
| 2014/0048277 | A1 * | 2/2014 | June | E21B 33/0407 166/368 |
| 2016/0208603 | A1 | 7/2016 | Barfoot et al. | |
| 2018/0245424 | A1 | 8/2018 | Stokley et al. | |
| 2019/0120008 | A1 | 4/2019 | DeBerry et al. | |
| 2021/0115786 | A1 | 4/2021 | Cerrahoglu et al. | |
| 2021/0199832 | A1 | 7/2021 | Wu et al. | |

FOREIGN PATENT DOCUMENTS

| | | | |
|---|---|---|---|
| WO | 2016/068931 | A1 | 5/2016 |
| WO | 2016/134875 | A1 | 9/2016 |

OTHER PUBLICATIONS

Patents Act 1977: Examination Report under Section 18(3), Application No. GB2017219.3, mailed Mar. 30, 2023, 3 pages.

* cited by examiner

DOWNHOLE FIBER OPTIC TRANSMISSION FOR REAL-TIME WELL MONITORING AND DOWNHOLE EQUIPMENT ACTUATION

CROSS-REFERENCE TO RELATED APPLICATION

The present application is a continuation of U.S. patent application Ser. No. 17/088,840 filed on Nov. 4, 2020, which claims the benefit of U.S. Provisional Application Ser. No. 62/934,290 filed on Nov. 12, 2019, which is incorporated herein by reference in its entirety for all purposes.

TECHNICAL FIELD

The present disclosure relates generally to wellhead systems and, more particularly, to a fiber optic connection through a wellhead that allows for real-time monitoring of well conditions and real-time actuation of downhole equipment.

BACKGROUND

Conventional wellhead systems include a wellhead housing mounted on the upper end of a subsurface casing string extending into the well bore. During a drilling procedure, a drilling riser and BOP are installed above a wellhead housing (casing head) to provide pressure control as casing is installed, with each casing string having a casing hanger on its upper end for landing on a shoulder within the wellhead housing. A tubing string is then installed through the well bore. A tubing hanger connectable to the upper end of the tubing string is supported within the wellhead housing above the casing hanger for suspending the tubing string within the casing string. Upon completion of this process, the BOP is replaced by a Christmas tree installed above the wellhead housing, with the tree having a valve to enable the oil or gas to be produced and directed into flow lines for transportation to a desired facility.

It is sometimes desirable to provide power or communication signals in real-time between surface level equipment (e.g., at a floating rig or vessel) and components located in a subsea wellbore below the wellhead system. Unfortunately, transmission of signals uphole and downhole using conventional electrical lines is susceptible to undesirable signal loss. Further, for conventional subsea wells, time must be spent aligning the electrical lines of the wellhead components.

BRIEF DESCRIPTION OF THE DRAWINGS

For a more complete understanding of the present disclosure and its features and advantages, reference is now made to the following description, taken in conjunction with the accompanying drawing, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business-related constraints, which will vary from one implementation to another. Moreover, it will be appreciated that such a development effort might be complex and time consuming but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to a fiber optic connection between a surface location and subsea wellbore through a wellhead system.

Existing wellhead systems generally include a tubing hanger that is disposed within a wellhead to hold a tubing string deployed downhole, and a tree that is positioned on the wellhead to form fluid connections to downstream components. Electrical, hydraulic, and/or fiber optic signals are often communicated through the wellhead system, between the tree and the tubing hanger. In existing wellhead systems, a tree that is positioned on the wellhead must be properly oriented with respect to the tubing hanger that is set in the wellhead to make up multiple couplings or stabs between the tubing hanger and the tree. These couplings or stabs allow electric, hydraulic, and/or fiber optic signals to be communicated from the tree to the tubing hanger and various downhole components.

The present disclosure is directed to systems and methods for real-time data monitoring of well conditions and/or actuation of downhole equipment through the use of a fiber optic cable running through a wellhead system. In certain embodiments, as described in detail below, the wellhead system may include a "non-oriented" tubing hanger and tree. The term "non-oriented," means that neither the tubing hanger nor the tree need to be oriented with respect to each other or the wellhead to make desired electrical/fiber optic connections therebetween that facilitate the disclosed fiber optic communication.

Figure 1:
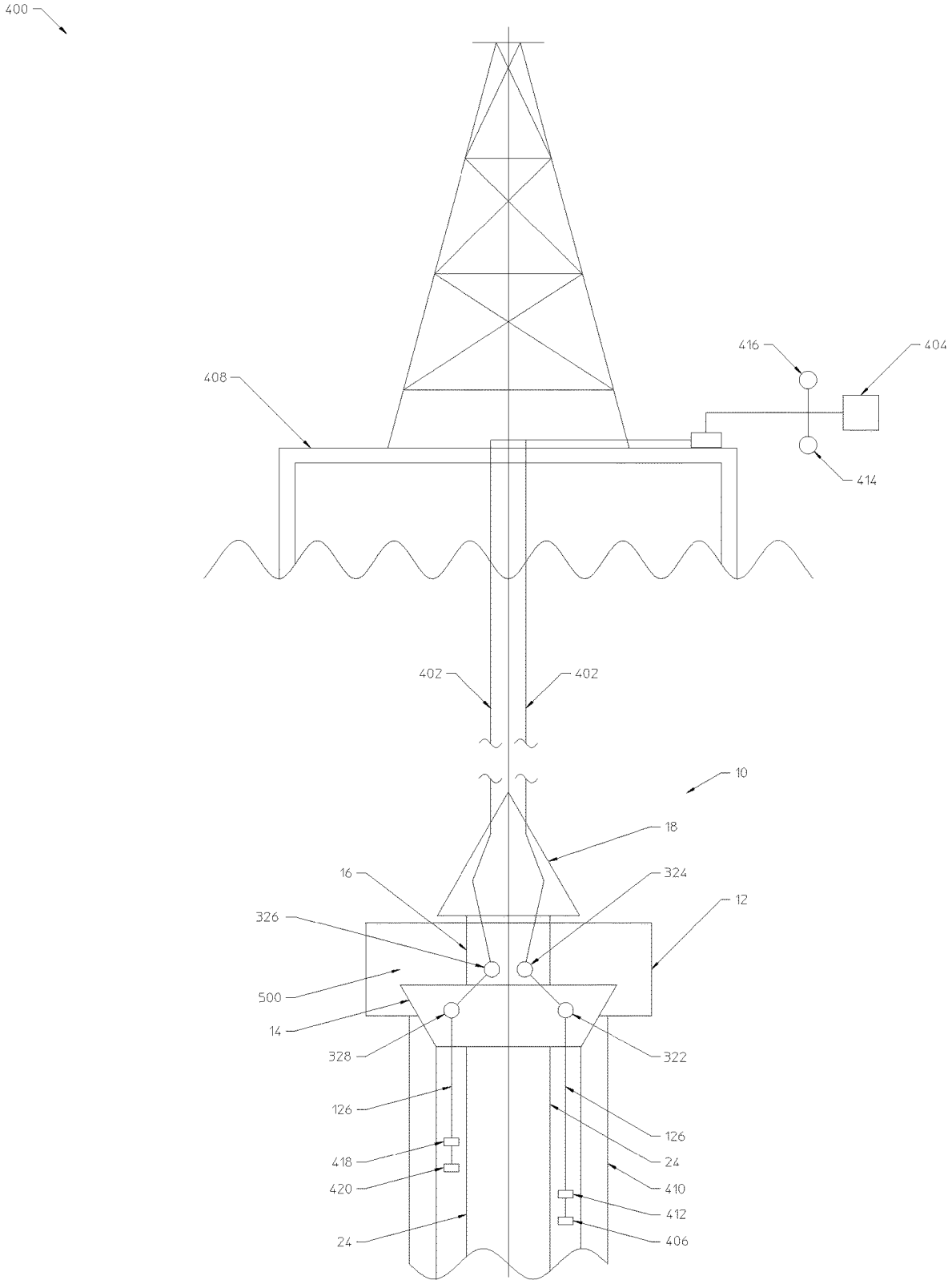
FIG. 1 is an overview of a well monitoring system, in accordance with an embodiment of the present disclosure.

Turning now to the drawings, FIG. 1 illustrates a well monitoring system 400 that may be utilized for real-time data acquisition and actuation of downhole tools within a subsea wellhead system 10. The well monitoring system 400 may comprise one or more fiber optic cables 402, an information handling system 404, an analog transducer 406, and a fiber optic connection assembly 500 located at a subsea wellhead system 10. The one or more fiber optic cables 402 may communicatively couple an offshore platform 408 to the fiber optic connection assembly 500 at the wellhead system 10. The information handling system 404 may be disposed about the offshore platform 408 and may be communicatively coupled to the one or more fiber optic cables 402. The one or more fiber optic cables 402 may be separate individual cables or part of the same cable bundle. The one or more fiber optic cables 402 may extend from the offshore platform 408 to the wellhead system 10 through a riser connecting the platform 408 to the wellhead system 10, or through an umbilical.

The analog transducer 406 may be disposed about any suitable location within a subsea well 410 disposed below the wellhead system 10. As illustrated, the analog transducer 406 may be disposed about a tubing string 24 suspended from a tubing hanger 14. During operations, the analog transducer 406 may output an electrical signal to be communicated uphole to a surface location (such as the offshore platform 408). The outputted signal may represent current or voltage. The analog transducer 406 may be a downhole sensor used to detect various downhole parameters including, for example, a temperature, a pressure, a flowrate, a position or presence of a component being moved through the wellbore 410, and the like.

There may be an optical transmitter 412 coupled to the analog transducer 406, and the optical transmitter 412 may convert the electrical signal from the analog transducer 406 into a light signal to be transmitted uphole via the fiber optic communications line 126. Without limitations, the optical transmitter 412 may be a light-emitting diode (LED) or a laser diode. The light may be transmitted through the fiber optic communications line 126 up to the wellhead system 10. The fiber optic communications line 126 may be disposed within a casing string (for example, an inner casing string or an outer casing string) below the wellhead system 10 and may traverse up to the wellhead system 10, e.g., through the tubing hanger 14. In other embodiments, the fiber optic communications line 126 may be disposed radially outside of a casing string and traverse up to the wellhead system 10. In such instances, the fiber optic communications line 126 may be cemented in place around the casing prior to making up the fiber optic connection assembly 500 at the wellhead system 10.

The fiber optic connection assembly 500 is established at the wellhead system 10 to allow an external fiber optic cable, such as the one or more fiber optic cables 402, to be communicatively coupled to the fiber optic communications line 126 within the well 410. The fiber optic connection assembly 500 generally includes a photodetector 322 communicatively coupled to the fiber optic communication line 126. The photodetector 322 may convert a light signal travelling through the fiber optic communication line 126 from downhole to an analog electrical signal within the wellhead system 10. Without limitations, the photodetector 322 may be a photodiode or a photovoltaic cell. The fiber optic connection assembly 500 also includes an optical transmitter 324 communicatively coupled to one of the fiber optic cables 402. The optical transmitter 324 may be configured to convert the analog electrical signal from the photodetector 322 into a light signal. Without limitations, the optical transmitter 324 may be a light-emitting diode (LED) or a laser diode. Once the fiber optic/electrical connections are established within the fiber optic connection assembly 500 within the wellhead system 10, the light signal may be converted to an electrical signal through the photodetector 322, transferred through an electrical connection (e.g., electrical connection 132 as described below), converted back into a light signal through the optical transmitter 324, and travel further to and up through one of the fiber optic cables 402.

As the light signal is transmitted to the offshore platform 408, there may be another photodetector 414 disposed at the offshore platform 408 configured to convert the light signal back to an analog electrical signal. In one or more embodiments, the photodetector 414 may be communicatively coupled to the one or more fiber optic cables 402 and the information handling system 404. In embodiments, this analog electrical signal may be converted into a digital signal for calibrated data acquisition through the information handling system 404. This may provide for a better means of transferring information as there is not any significant signal loss like that which occurs through conventional electrical lines.

In embodiments, communication may occur from downhole to the offshore platform 408 and vice versa through the one or more fiber optic cables 402. For example, in certain embodiments the fiber optic connection assembly 500 may also include a second photodetector 326 and a second optical transmitter 328. The second photodetector 326 may be communicatively coupled to another one of the fiber optic cables 402. The photodetector 326 may convert a light signal travelling through the fiber optic cable 402 from the surface to an analog electrical signal within the wellhead system 10. The optical transmitter 328 may be communicatively coupled to another of the fiber optic communications lines 126. The optical transmitter 328 may be configured to convert the analog electrical signal from the photodetector 326 into a light signal. In this embodiment, a light signal may be travelling towards the fiber optic connection assembly 500 from a surface location via the fiber optic cable 402. As the light signal approaches the wellhead system 10, the light signal may be converted to an electrical signal via the photodetector 326, transferred through the electrical connection (e.g., electrical connection 132, as described below), converted back into a light signal through the optical transmitter 328, and travel downhole along fiber optic communications line 126.

There may be another optical transmitter 416 disposed at the offshore platform 408 that is configured to emit a signal as a light to be transmitted down to the wellhead system 10 via the one or more fiber optic cables 402, wherein the optical transmitter 416 is communicatively coupled to the one or more fiber optic cables 402 and the information handling system 404. After the light signal is transmitted through the wellhead system 10, the light signal travels downhole via one of the fiber optic communication lines 126. There may be another photodetector 418 located downhole and configured to convert the light signal from the fiber optic communication line 126 into electricity. The photodetector 418 may be disposed about any suitable location downhole. As illustrated, the photodetector 418 may be disposed about or within the tubing string 24. In embodiments, the electricity may be used to charge a power supply 420, such as a capacitor bank or a pulse form network, without limitation. The power supply 420 may store this energy to actuate a suitable electro-mechanical device, such as a solenoid or a motor, without limitation. The energy stored in the power supply 420 may be used to actuate any number of downhole tools, such as slidable sleeves, valves, packers, sensors, communication systems, processing components, and the like. This method may provide enhanced power communications to actuate downhole equipment, as opposed to existing electrical lines (which experience power loss).

Having now described the general components of the fiber optic connection assembly 500 used in the wellhead to implement enhanced real-time well monitoring and downhole equipment actuation, a more detailed example of a wellhead system that facilitates this fiber optic connection assembly 500 will be provided.

Figure 2:
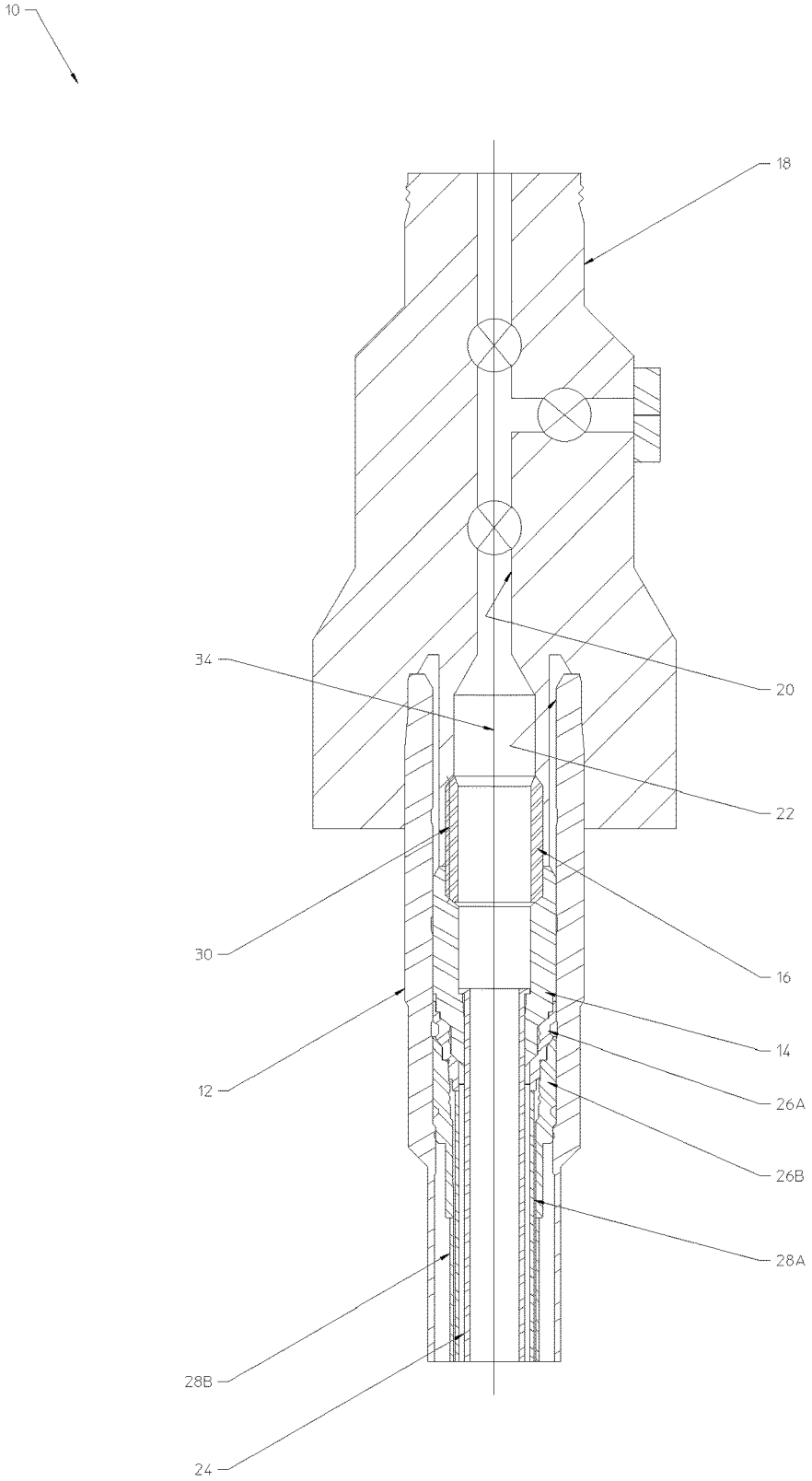
FIG. 2 is a schematic cutaway view of components of a wellhead system that may be used to facilitate the well monitoring system of FIG. 1, in accordance with an embodiment of the present disclosure.

FIG. 2 illustrates certain components of a subsea wellhead system 10 which may be used to provide the fiber optic connection described above. The wellhead system 10 may include this fiber optic connection between a tubing hanger 14 and a production tree 18. In certain embodiments, the tubing hanger 14 and the production tree 18 used to provide the disclosed downhole-to-surface fiber optic communication may be provided via an electrical connection (e.g., electrical connection 132 as described below) that does not require the tubing hanger 14 and the tree 18 to be oriented in any particular orientation with respect to each other or a wellhead 12. The wellhead system 10 depicted in FIG. 2 may include a wellhead 12, a tubing hanger 14, a seal sub 16, and a production tree 18. The production tree 18 may include various valves for fluidly coupling a vertical bore 20 formed through the tree 18 to one or more downstream production flowpaths (for example, a well jumper). The tree 18 may be connected to and sealed against the wellhead 12. The tubing hanger 14 may be fluidly coupled to the bore 20 of the tree 18. When the tree 18 is landed in the wellhead 12, as shown, the seal sub 16 disposed on the tree 18 may be connected to the tubing hanger 14.

The tubing hanger 14 may be landed in and sealed against a bore 22 of the wellhead 12, as shown. The tubing hanger 14 may suspend a tubing string 24 into and through the wellhead 12. Likewise, one or more casing hangers (e.g., inner casing hanger 26A and outer casing hanger 26B) may be held within and sealed against the bore 22 of the wellhead 12 and used to suspend corresponding casing strings (e.g., inner casing string 28A and outer casing string 28B) through the wellhead 12.

In the illustrated embodiment, the seal sub 16 may include one or more communication lines (e.g., hydraulic fluid lines, electrical lines, and/or fiber optic lines) 30 disposed therethrough and used to communicatively couple the tree 18 to the tubing hanger 14. The seal sub 16 is designed to establish hydraulic, electric, and/or fiber optic communication between the tree 18 and the tubing hanger 14 regardless of the orientations (relative to longitudinal axis 34) in which the tree 18 and the tubing hanger 14 are landed in the wellhead 12.

Figure 3:
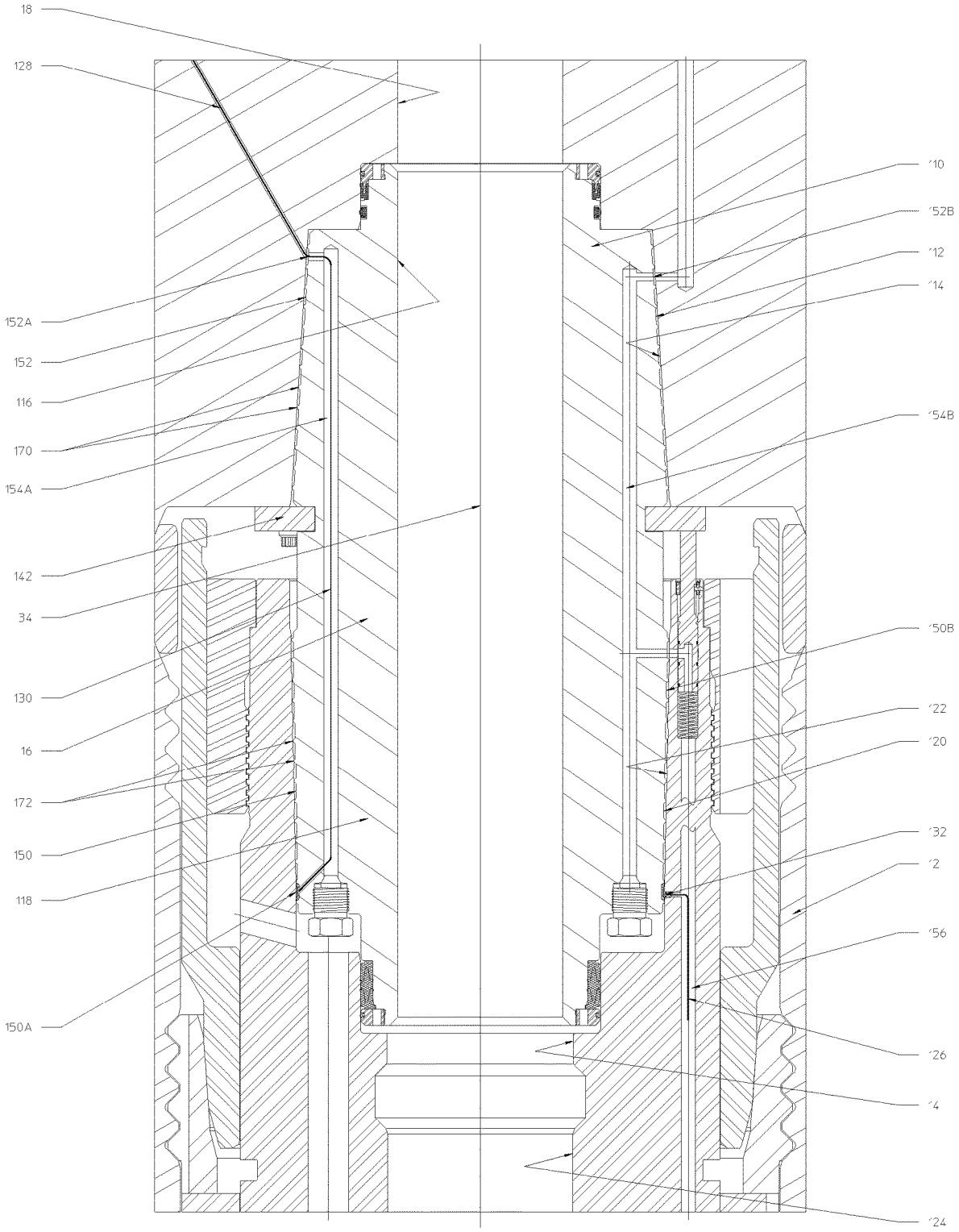
FIG. 3 is a detailed cross-sectional view of the wellhead system of FIG. 2 having a non-orientating tubing hanger and tree with a seal sub, in accordance with an embodiment of the present disclosure.

FIG. 3 provides a more detailed view of an embodiment of the wellhead system 10 including the non-orientating tubing hanger 14 and the tree 18 with the seal sub 16. In the illustrated embodiment, an upper end 110 of the seal sub 16 is disposed within an opening at a lower end of the tree 18. A radially outer wall 112 of the upper end 110 of the seal sub 16 interfaces with a corresponding radially inner wall 114 formed at the lower end of the tree 18. The seal sub 16 generally has a bore 116 formed therethrough that is longitudinally aligned with the bore 20 through the tree 18. As illustrated, the bore 116 of the seal sub 16 may have approximately the same diameter as the corresponding bore 20 of the tree 18.

In the illustrated embodiment, a lower end 118 of the seal sub 16 is disposed within an opening at an upper end of the tubing hanger 14. A radially outer wall 120 of the lower end 118 of the seal sub 16 interfaces with a corresponding radially inner wall 122 at the upper end of the tubing hanger 14. The tubing hanger 14 generally has a bore 124 formed therethrough that is longitudinally aligned with the bore 116 of the seal sub 16. As illustrated, the bore 116 of the seal sub 16 may have approximately the same diameter as the corresponding bore 124 of the tubing hanger 14.

FIG. 3 illustrates the tubing hanger 14, seal sub 16, and tree 18 in fully landed positions within and/or on the wellhead 12. That is, the tubing hanger 14 is landed in a desired position within a bore of the wellhead 12, and the seal sub 16 and tree 18 are both landed such that the seal sub 16 is disposed within and engaged with the tubing hanger 14. In this landed position, the seal sub 16 provides electric, fiber optic, and/or hydraulic communication between the tree 18 and the tubing hanger 14 regardless of the relative orientation (about axis 34) of the tree 18 with respect to the tubing hanger 14.

In the illustrated arrangement, the seal sub 16 is attached to the tree 18 in such a manner that the tree 18 and seal sub 16 may be lowered together onto the tubing hanger 14 for positioning of these components in their landed positions.

In other embodiments, however, the seal sub 16 may instead be attached to the tubing hanger 14 such that the seal sub 16 is lowered into the wellhead 12 along with the tubing hanger 14 and the tree 18 is later lowered down onto the tubing hanger 14 and seal sub 16.

As illustrated, the tubing hanger 14 and the tree 18 may each include at least one fiber optic communication line (126 of the tubing hanger 14 and 128 of the tree 18). The seal sub 16 also may include at least one corresponding fiber optic communication line 130. The fiber optic communication line(s) 130 of the seal sub 16 may be extensions of the same fiber optic communication line(s) 128 of the tree 18 coupled to the seal sub 16. The fiber optic communication line(s) 130 of the seal sub 16 may be coupled to the fiber optic communication line(s) 126 of the tubing hanger 14 via an electrical connection 132 located at an interface of the radially inner wall 122 of the tubing hanger 14 and the radially outer wall 120 of the seal sub 16. The type and arrangement of electrical connection 132 that may be utilized in the wellhead system 10 is described below with reference to FIG. 3.

In some embodiments, the fiber optic communication line(s) 130 of the seal sub 16 may be similarly coupled to the fiber optic communication line(s) 128 of the tree 18 via an electrical connection located at an interface of the radially inner wall 114 of the tree 18 and the radially outer wall 112 of the seal sub 16.

The seal sub 16 may be attached to the lower end of the tree 18 by any desired attachment mechanism. As one example, the illustrated seal sub 16 is attached to the lower end of the tree 18 via a locking ring (e.g., c-shaped locking ring) 142 or flange that is received into an indentation formed in the radially outer wall 112 of the seal sub 16. The flange portion of the locking ring 142 or flange may be bolted directly to the tree 18, thereby attaching the seal sub 16 to the tree 18 so that the seal sub 16 can be lowered into position with the tree 18.

Although the illustrated embodiment shows the seal sub 16 attached to the tree 18 for positioning within the wellhead 12, other embodiments of the wellhead system 10 may include the seal sub 16 as an attachment to the tubing hanger 14 such that the seal sub 16 is initially lowered with the tubing hanger 14 into position within the wellhead 12. In such embodiments, an attachment mechanism (e.g., locking ring, flange, etc.) may be used to directly couple the seal sub 16 to the tubing hanger 14, instead of the tree 18. The fiber optic communication line(s) 128 of the tree 18 and line(s) 130 of the seal sub 16 would be connected via one or more electrical galleries. The fiber optic communication line(s) 130 of the seal sub 16 may be an extension of the same fiber optic communication line(s) 126 of the tubing hanger 14.

The seal sub 16 is equipped with two different types of gallery metal-to-metal seals, one type of seal 170 provided on the outer wall 112 on the upper portion of the seal sub 16 and the other type of seal 172 provided on the outer wall 120 on the lower portion of the seal sub 16. The first type of seal 170 provided on the outer wall 112 is designed to seal an interface between the seal sub 16 and the tree 18 when the seal sub 16 is attached to the tree 18. The second type of seal 172 provided on the outer wall 120 is designed to seal an interface between the seal sub 16 and the tubing hanger 14 once the seal sub 16 has been lowered into engagement with the tubing hanger 14. On the tree side of the seal sub (i.e., outer wall 112), the metal-to-metal seals 170 may include elastomeric backups, and the metal-to-metal seals 170 may be preloaded on a tapered surface (inner wall 114) of the tree 18. When the seal sub 16 is fastened to the tree 18 (e.g., via the locking ring 142), the tree 18 maintains the preload on the metal-to-metal seals 170. The seals 172 on the tubing hanger side of the seal sub 16 will be described below with reference to FIG. 3.

Several metal-to-metal seals (170, 172) may be made up on either portion (upper or lower) of the seal sub 16 to provide a desired number of sealed zones independent from each other within the seal sub 16. When the metal-to-metal seals are made up, they create a gallery of these sealed zones.

One or more zones 150 on the lower part of the seal sub 16 may be communicatively coupled to one or more zones 152 on the upper part of the seal sub 16 via passages that are drilled through the body of the seal sub 16. As shown in FIG. 3, the seal sub 16 may include at least a first passage 154A for routing the fiber optic communication line 130 between one of the upper level sealed zones 152A and one of the lower level sealed zones 150A. The seal sub 16 may also include a second passage 154B, for routing hydraulic fluid between one of the upper level sealed zones 152B and one of the lower level sealed zones 150B. It should be noted that the different upper level sealed zones 152A and 152B are independent from each other and separated via the metal-to-metal seals 170, and the lower level sealed zones 150A and 150B are independent from each other and separated via the metal-to-metal seals 172. However, as shown in FIG. 3, the separate passages 154A and 154B through the seal sub 16 may provide both electrical and hydraulic communications from the seal sub 16 ultimately to the same passage 156 (conduit 134) formed through the tubing hanger 14. However, the communication signals are provided to this same passage 156 through two different lower level sealed zones 150A and 150B.

The sealed zones 150/152 are generally concentric and extend a full 360 degrees around the outer walls of the seal sub 16, so that communication through the seal sub 16 is possible at any angle. That way, the sealed zones 150/152 allow fluids or electrical connections to pass through the seal sub 16 without the seal sub 16 needing to be at a specific orientation relative to the tubing hanger 14 or to the tree 18.

Figure 4:
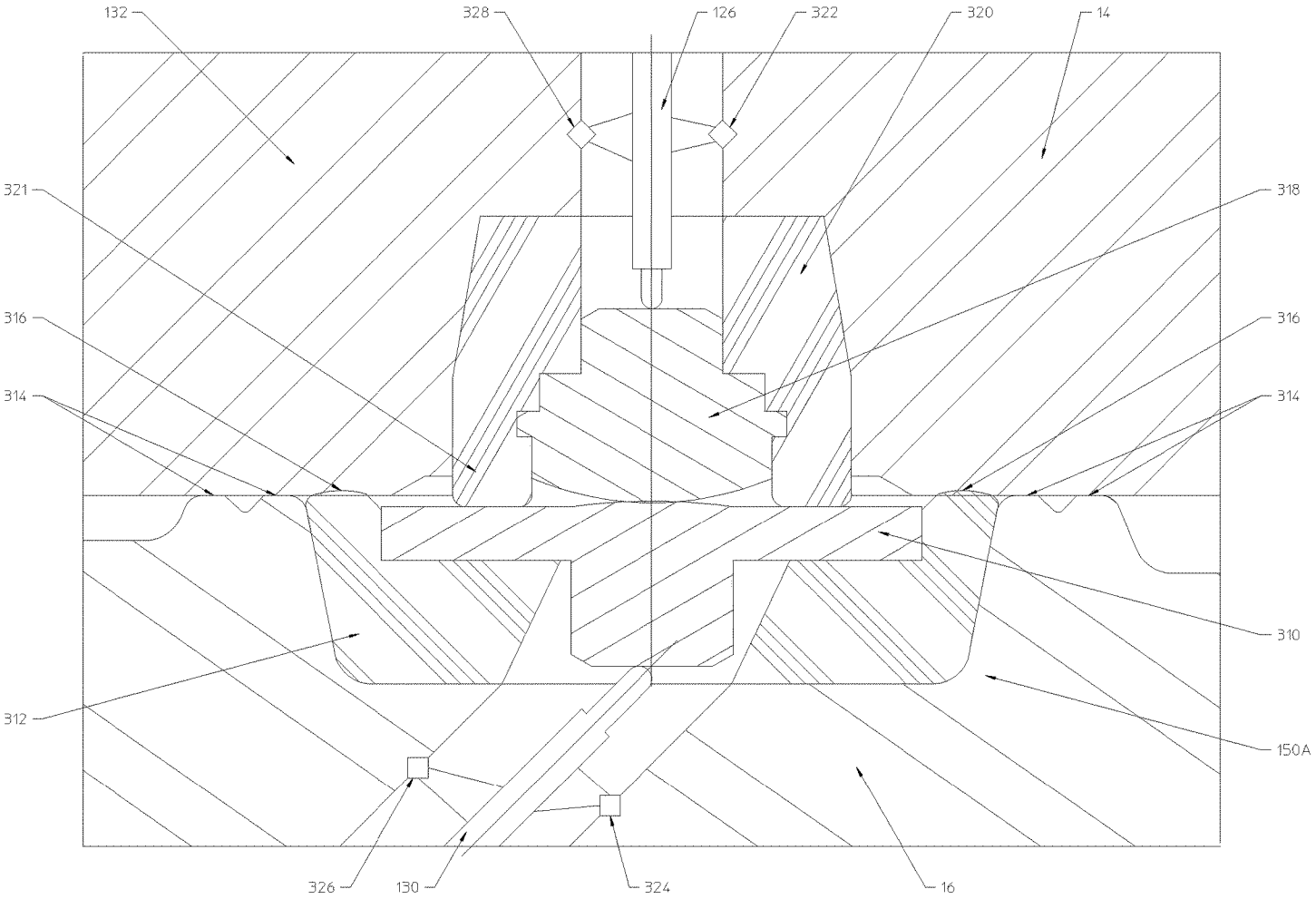
FIG. 4 is a cross-sectional view of an electrical connection formed within a sealed zone of the seal sub of FIG. 3, in accordance with an embodiment of the present disclosure.

Turning to FIG. 4, an embodiment of the electrical connection 132 that may be utilized in the disclosed seal sub 16 will now be described. The electrical connection 132 between the seal sub 16 and the tubing hanger 14 may include an electrical conductor 310 that is housed within a specific gallery (sealed zone 150A) formed by the seal sub 16. The electrical conductor 310 may be insulated via an elastomeric shroud 312 that contacts the mating side of the gallery.

As discussed above, the seal sub 16 may include a series of metal-to-metal seals 172 with corresponding elastomeric sealing components, and these are illustrated in detail in FIG. 4. Specifically, the seal sub 16 includes multiple metal-to-metal protrusions 314 configured to sealingly engage the straight inner wall 122 of the tubing hanger 14. The seal sub 16 also includes the elastomeric shroud 312, which may include protrusions 316 configured to sealingly engage the straight inner wall 122 of the tubing hanger 14 on either side of the electrical conductor 310. In this way, the elastomeric shroud 312 functions as both another sealing element of the seal 172 and an insulator for the electrical conductor 310. The metal-to-metal protrusions 314, elastomeric shroud 312 (and its protrusions 316), and the electrical conductor 310 may all extend 360 degrees about an axis of the seal sub 16, thereby filling the circumferential sealed zone 150A. FIG. 4 shows the fiber optic communications line 130 of the seal sub 16 which terminates at the electrical conductor 310 and is in electrical contact with the conductor 310.

The electrical connection 132 may also include an electrical contact 318 on the tubing hanger side of the connection. The tubing hanger 14 may include an insulating elastomeric shroud 320 (with protrusion 321) that is configured to sealingly contact the electrical conductor 310 when the seal sub 16 is landed in the tubing hanger 14. This elastomeric shroud 320 may provide a tertiary seal for the zone 150A, in addition to the metal-to-metal protrusions 314 and the elastomeric shroud 312 of the seal 172 on the seal sub 16. The electrical contact 318 and its shroud 320 may be located at a specific circumferential position within the inner wall 122 of the tubing hanger 14, or the electrical contact 318 and shroud 320 may extend 360 degrees about an axis of the tubing hanger 14 like the electrical conductor 310 of the seal sub 16. Either way, the contact 318 will make electrical contact with the conductor 310 no matter what the relative orientation is between the seal sub 16 and the tubing hanger 14. FIG. 4 shows the fiber optic communications line 126 of the tubing hanger 14 which terminates at and is electrically coupled to the contact 318.

All wires or electrical pathways through the seal sub 16, tubing hanger 14, and tree 18 are pre-installed and sealed prior to running the seal sub 16 into place to form the electrical connection of FIG. 4.

Although FIG. 4 illustrates the fiber optic communications line 130 of the seal sub 16 as being at the same relative orientation as the fiber optic communications line 126 of the tubing hanger 14, this is only to illustrate how each side interfaces with the sealed electrical connection zone 150A. When the seal sub 16 is fully landed, the fiber optic communications lines 130 and 126 will be in electrical communication regardless of the relative orientation of the seal sub 16 to the tubing hanger 14, since the sealed connection zone 150A extends through all 360 degrees about the seal sub 16. The fiber optic communications line 130 of the seal sub 16 may contact the conductor 310 at one position along the circumference of the assembly while the fiber optic communications line 126 of the tubing hanger 14 may be located at another circumferential position, but these fiber optic communications lines 126 and 130 are still connected through the sealed electrical connection zone 150A.

In such embodiments, the communication signal coming into and leaving the electrical connection 132 would be light transmitted through a fiber optic cable (for example, fiber optic communications line 126, 130). Incoming light traveling through a fiber optic cable that is routed through the seal sub 16 is converted into an electrical signal, which travels through the electrical connection 132. After traveling to the contact 318 on the tubing hanger side of the electrical connection 132, the electrical signal may then be converted back to a light signal for communication through a fiber optic cable within the tubing hanger 14.

As illustrated, the photodetector 322 may be disposed about and electrically coupled to the fiber optic communication line 126. The photodetector 322 may convert a light signal travelling from downhole of a well to an analog electrical signal. Without limitations, the photodetector 322 may be a photodiode or a photovoltaic cell. There may be an optical transmitter 324 disposed about and electrically coupled to the fiber optic communication line 130, wherein the optical transmitter 324 may be configured to convert the analog electrical signal into a light signal. Without limitations, the optical transmitter 324 may be a light-emitting diode (LED) or a laser diode. As previously described, once the seal sub lands and couples to the tubing hanger 14, the electrical connection 132 may be established. Once the electrical connection 132 has been established, the light signal may transmit to the electrical connection 132 from the tubing hanger 14, be converted to an electrical signal through the photodetector 322, be transferred to the seal sub 16 through the electrical connection 132, be converted back into a light signal through the optical transmitter 324, and travel further along fiber optic communications line 130.

As mentioned above, there may be a second photodetector 326 and a second optical transmitter 328. As shown in FIG. 4, the second photodetector 326 may be disposed about and electrically coupled to the fiber optic communications line 130, and the second optical transmitter 328 may be disposed about and electrically coupled to the fiber optic communications line 126. In these embodiments, a light signal may be travelling towards the seal sub 16 along the fiber optic communications line 130 from a surface location. As the light signal approaches the seal sub 16, the light signal may be converted to an electrical signal via the second photodetector 326, transferred to the tubing hanger 14 through the electrical connection 132, converted back into a light signal through the second optical transmitter 328, and travel further along fiber optic communications line 126.

Although the present disclosure and its advantages have been described in detail, it should be understood that various changes, substitutions and alterations can be made herein without departing from the spirit and scope of the disclosure as defined by the following claims.

What is claimed is:

1. A subsea wellhead system, comprising:

a hanger comprising a bore and a first fiber optic cable;

a tree configured to be landed on the hanger, wherein the tree comprises a bore and a second fiber optic cable, wherein the second fiber optic cable is configured to extend from a surface location;

a seal sub configured to be coupled to the tree and configured to be landed in and engaged with the hanger, wherein the seal sub comprises:

a bore; and a fiber optic communications line that is configured to be communicatively coupled to both the first fiber optic cable and the second fiber optic cable;

a transducer configured to be disposed at a downhole location about a tubing string suspended from the hanger, wherein the first fiber optic cable is configured to be communicatively coupled to the transducer and to extend between the transducer and the seal sub;

a first photodetector disposed in the hanger and configured to be communicatively coupled to the first fiber optic cable, the first photodetector configured to convert a light signal traveling through the first fiber optic cable from downhole to an electrical signal communicated to the electrical connection; and a first optical transmitter disposed in the seal sub and communicatively coupled to the fiber optic communications line, the first optical transmitter configured to convert the electrical signal traveling through the electrical connection into a light signal communicated to the second fiber optic cable.

2. The subsea wellhead system of claim 1, further comprising a second photodetector configured to be disposed at the surface location, wherein the second photodetector is configured to convert the light signal from the second fiber optic cable into an electrical signal to be used by an information handling system.

3. The subsea wellhead system of claim 1, further comprising a second optical transmitter configured to be disposed at a downhole location about the tubing string, wherein the second optical transmitter is coupled to the transducer and configured to convert an electrical signal from the transducer into a light signal to be transmitted via the first fiber optic cable.

4. The subsea wellhead system of claim 1, wherein the electrical connection comprises:

an electrical conductor housed in a gallery formed by the seal sub; and an electrical contact located within the inner wall of the hanger.

5. The subsea wellhead system of claim 4, wherein the electrical connection further comprises:

a first elastomeric shroud, wherein the electrical conductor is disposed within the first elastomeric shroud, and wherein the first elastomeric shroud contacts mating sides of the gallery.

6. The subsea wellhead system of claim 5, wherein the first elastomeric shroud comprises protrusions configured to sealingly engage an inner wall of the hanger on either side of the electrical conductor.

7. The subsea wellhead system of claim 5, wherein the electrical conductor and the first elastomeric shroud extend 360 degrees about an axis of the seal sub.

8. The subsea wellhead system of claim 4, wherein the electrical connection further comprises:

a second elastomeric shroud, wherein the electrical contact is disposed within the second elastomeric shroud, and wherein the second elastomeric shroud is configured to sealingly contact the electrical conductor.

9. The subsea wellhead system of claim 1, wherein the seal sub comprises multiple metal-to-metal protrusions configured to sealingly engage an inner wall of the hanger.

10. A subsea wellhead system, comprising:

a hanger comprising a bore and a first fiber optic cable;

a tree configured to be landed on the hanger, wherein the tree comprises a bore and a second fiber optic cable, wherein the second fiber optic cable is configured to extend from a surface location;

a seal sub configured to be coupled to the tree and configured to be landed in and engaged with the hanger, wherein the seal sub comprises:

a bore; and a fiber optic communications line that is configured to be communicatively coupled to both the first fiber optic cable and the second fiber optic cable;

a power supply configured to be disposed at a downhole location about a tubing string suspended from the hanger, wherein the first fiber optic cable is configured to be communicatively coupled to the power supply and to extend between the power supply and the seal sub;

a first photodetector disposed in the seal sub and communicatively coupled to the fiber optic communications line, the first photodetector configured to convert a light signal traveling through the second fiber optic cable from the surface location to an electrical signal communicated to the electrical connection; and a first optical transmitter disposed in the hanger and configured to be communicatively coupled to the first fiber optic cable, the first optical transmitter configured to convert the electrical signal traveling through the electrical connection into a light signal communicated to the first fiber optic cable.

11. The subsea wellhead system of claim 10, further comprising a second photodetector configured to be disposed at the downhole location, wherein the second photodetector coupled to the power supply and configured to convert the light signal from the first fiber optic cable into an electrical signal to charge the power supply.

12. The subsea wellhead system of claim 10, further comprising a second optical transmitter configured to be disposed at the surface location, wherein the second optical transmitter is configured to convert an electrical signal from an information handling system into a light signal to be transmitted via the second fiber optic cable.

13. The subsea wellhead system of claim 10, wherein the electrical connection comprises:

an electrical conductor housed in a gallery formed by the seal sub; and an electrical contact located within the inner wall of the hanger.

14. The subsea wellhead system of claim 13, wherein the electrical connection further comprises:

a first elastomeric shroud, wherein the electrical conductor is disposed within the first elastomeric shroud, and wherein the first elastomeric shroud contacts mating sides of the gallery.

15. The subsea wellhead system of claim 14, wherein the first elastomeric shroud comprises protrusions configured to sealingly engage an inner wall of the hanger on either side of the electrical conductor.

16. The subsea wellhead system of claim 14, wherein the electrical conductor and the first elastomeric shroud extend 360 degrees about an axis of the seal sub.

17. The subsea wellhead system of claim 13, wherein the electrical connection further comprises:

a second elastomeric shroud, wherein the electrical contact is disposed within the second elastomeric shroud, and wherein the second elastomeric shroud is configured to sealingly contact the electrical conductor.

18. The subsea wellhead system of claim 10, wherein the seal sub comprises multiple metal-to-metal protrusions configured to sealingly engage an inner wall of the hanger.

* * * * *